US007407420B2

(12) United States Patent
Fetchko et al.

(10) Patent No.: US 7,407,420 B2
(45) Date of Patent: Aug. 5, 2008

(54) TRIM AND TILT APPARATUS

(75) Inventors: Eric B. Fetchko, British Columbia (CA); Davor Baros, British Columbia (CA); Art Ferguson, Glenview, IL (US)

(73) Assignee: Teleflex Canada, Inc., Richmond, British Columbia ( * ) Notice: Subject to any disclaimer, the term of this patent is extended or adjusted under 35 U.S.C. 154(b) by 0 days.

(21) Appl. No.: 11/633,532

(22) Filed: Dec. 5, 2006

(65) Prior Publication Data

US 2008/0132128 A1 Jun. 5, 2008

(51) Int. Cl.
*B63H 5/125* (2006.01)

(52) U.S. Cl. ..... 440/61 T; 440/53

(58) Field of Classification Search ..... 440/53, 440/61 D, 61 R, 61 T, 63
See application file for complete search history.

(56) References Cited

U.S. PATENT DOCUMENTS 4,545,770 A 10/1985 Ferguson
4,720,278 A * 1/1988 Taguchi et al. ..... 440/61 R
4,764,134 A * 8/1988 Watanabe ..... 440/53
5,032,094 A 7/1991 Katogi
5,597,333 A * 1/1997 Soda ..... 440/61 R
6,071,157 A * 6/2000 Yoshino et al. ..... 440/61 R
6,824,435 B2 11/2004 Divisi
6,837,761 B2 * 1/2005 Saito ..... 440/61 D

* cited by examiner

*Primary Examiner*—Lars A Olson
(74) *Attorney, Agent, or Firm*—Baker & Hostetler LLP

(57) ABSTRACT

A trim and tilt system for use with an outboard propulsion unit on a marine craft having a transom. The trim and tilt system comprises a stern bracket configured to be mounted on the transom of the marine craft and a swivel bracket for supporting the outboard propulsion unit. The swivel bracket is pivotally supported on an upper end of the stern bracket. There is also a tilt cylinder unit that has a lower end supported by the stern bracket and an upper end in pivotal engagement with the swivel bracket. The tilt cylinder unit pivotally supports a pair of trim cylinder units. Each of the trim cylinder units is on an opposite side of the tilt cylinder unit. Each said trim cylinder unit has a longitudinal axis, a lower end in pivotal arrangement with the tilt cylinder unit and a trim rod for engagement with the swivel bracket. The swivel bracket has means for aligning the trim rods therewith, whereby the force exerted by the swivel bracket on the trim cylinder unit is substantially along the longitudinal axis. There is also means for actuating the tilt cylinder unit and the trim cylinder units.

12 Claims, 13 Drawing Sheets

TRIM AND TILT APPARATUS

BACKGROUND OF THE INVENTION

1. Field of the Invention

The present invention relates to a trim and tilt system for use with an outboard motor mounted on a marine craft.

2. Description of Related Art

Conventional trim and tilt systems include a unitary trim and tilt cylinder apparatus, as disclosed in U.S. Pat. No. 5,032,094, issued Jul. 1, 1991 to Sadaji Katogi, hereinafter Katogi. Katogi discloses a trim and tilt system for trimming and tilting an outboard propulsion unit on a boat. The trim and tilt system disclosed by Katogi includes a unitary trim and tilt cylinder apparatus having a tilt cylinder unit and a trim cylinder unit, a stem bracket adapted to be mounted on the transom of the boat, a swivel bracket for supporting the outboard propulsion unit, the swivel bracket being pivotally supported on an upper end of the stem bracket, and a hydraulic pressure circuit for actuating the tilt cylinder unit and the trim cylinder unit. The trim and tilt cylinder apparatus has an upper end pivotally supported on the stern bracket and a lower end pivotally supported on the swivel bracket.

The trim and tilt system disclosed by Katogi has the disadvantage of undue stress being applied to the trim cylinder units at a point of contact of a trim rod of each of the trim cylinder units with the swivel bracket. This excessive stress is in part due to the unitary construction of the trim and tilt cylinder apparatus. As the outboard propulsion unit pivots during the trimming and tilting procedure, the angle of the trim rods of each of the trim cylinder units changes with respect to the swivel bracket. The weight of the propulsion unit is therefore applied to the trim rod through the swivel bracket at various angles throughout the trimming procedure. This leads to a considerable amount of transverse stress being applied between the trim rods and their respective trim cylinders, leading to undue wear and fatigue.

There is therefore a need for a new and improved trim and tilt system that reduces the stress experienced by trim cylinder units during the trimming of a marine propulsion unit.

SUMMARY OF THE INVENTION

According to a first aspect of the present invention there is provided a trim and tilt system for use with an outboard propulsion unit on a marine craft having a transom. The trim and tilt system comprises a stem bracket configured to be mounted on the transom of the marine craft and a swivel bracket for supporting the outboard propulsion unit. The swivel bracket is pivotally supported on an upper end of the stem bracket. There is also a tilt cylinder unit that has a lower end supported by the stem bracket and an upper end in pivotal engagement with the swivel bracket. The tilt cylinder unit pivotally supports a pair of trim cylinder units. Each of the trim cylinder units is on an opposite side of the tilt cylinder unit. Each said trim cylinder unit has a longitudinal axis, a lower end in pivotal arrangement with the tilt cylinder unit and a trim rod for engagement with the swivel bracket. The swivel bracket has means for aligning the trim rods therewith, whereby the force exerted by the swivel bracket on the trim cylinder unit is substantially along the longitudinal axis. There is also means for actuating the tilt cylinder unit and the trim cylinder units.

According to a second aspect of the present invention there is provided a method of reducing stress on a trim cylinder unit of a trim and tilt system during trimming and tilting of a marine propulsion unit, the stress resulting from the weight of the marine propulsion unit being transmitted through a swivel bracket to the trim cylinder unit, the method comprising the step of transmitting the weight of the marine propulsion unit substantially along the longitudinal axis of the trim cylinder unit throughout the trimming of the marine propulsion unit.

BRIEF DESCRIPTION OF THE DRAWINGS

The present invention will be more readily understood from the following description of preferred embodiments thereof given, by way of example, with reference to the accompanying drawings, in which.

DETAILED DESCRIPTION OF THE PREFERRED EMBODIMENTS

Figure 1:
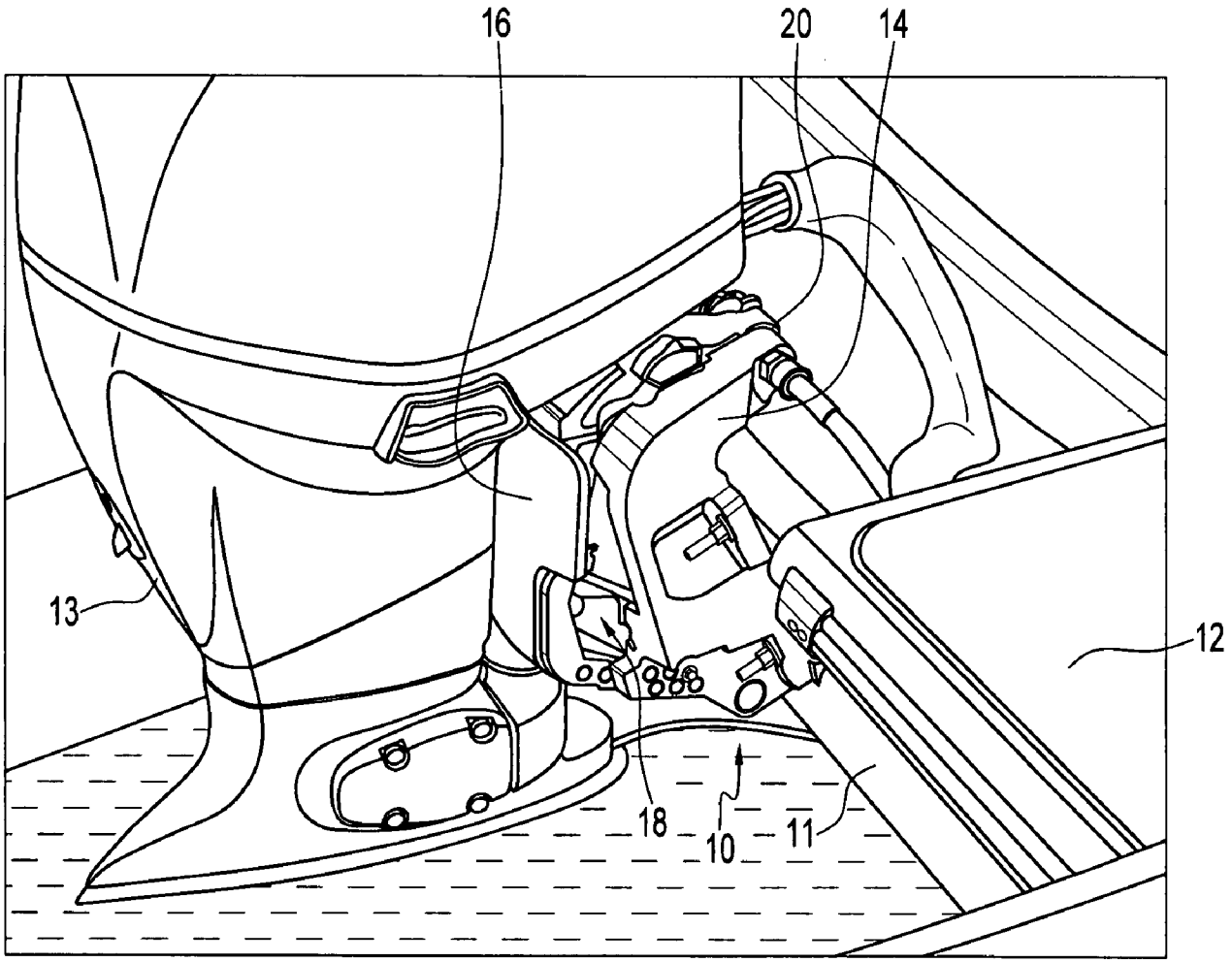
FIG. 1 is a perspective view of a trim and tilt system in operative arrangement between a marine craft and a motor according to an embodiment of the present invention.

Referring to the drawings and first to FIG. 1 there is shown a trim and tilt system, indicated generally by reference numeral 10, for trimming and tilting an outboard propulsion unit 13. The trim and tilt system 10 is operatively mounted on a transom 11 of a marine craft 12 and operates to position the propulsion unit 13 between a lower position and an upper position. The trim and tilt system 10 includes a stem bracket 14, a swivel bracket 16 and a trim and tilt cylinder apparatus which is indicated generally by reference numeral 18.

Figure 14:
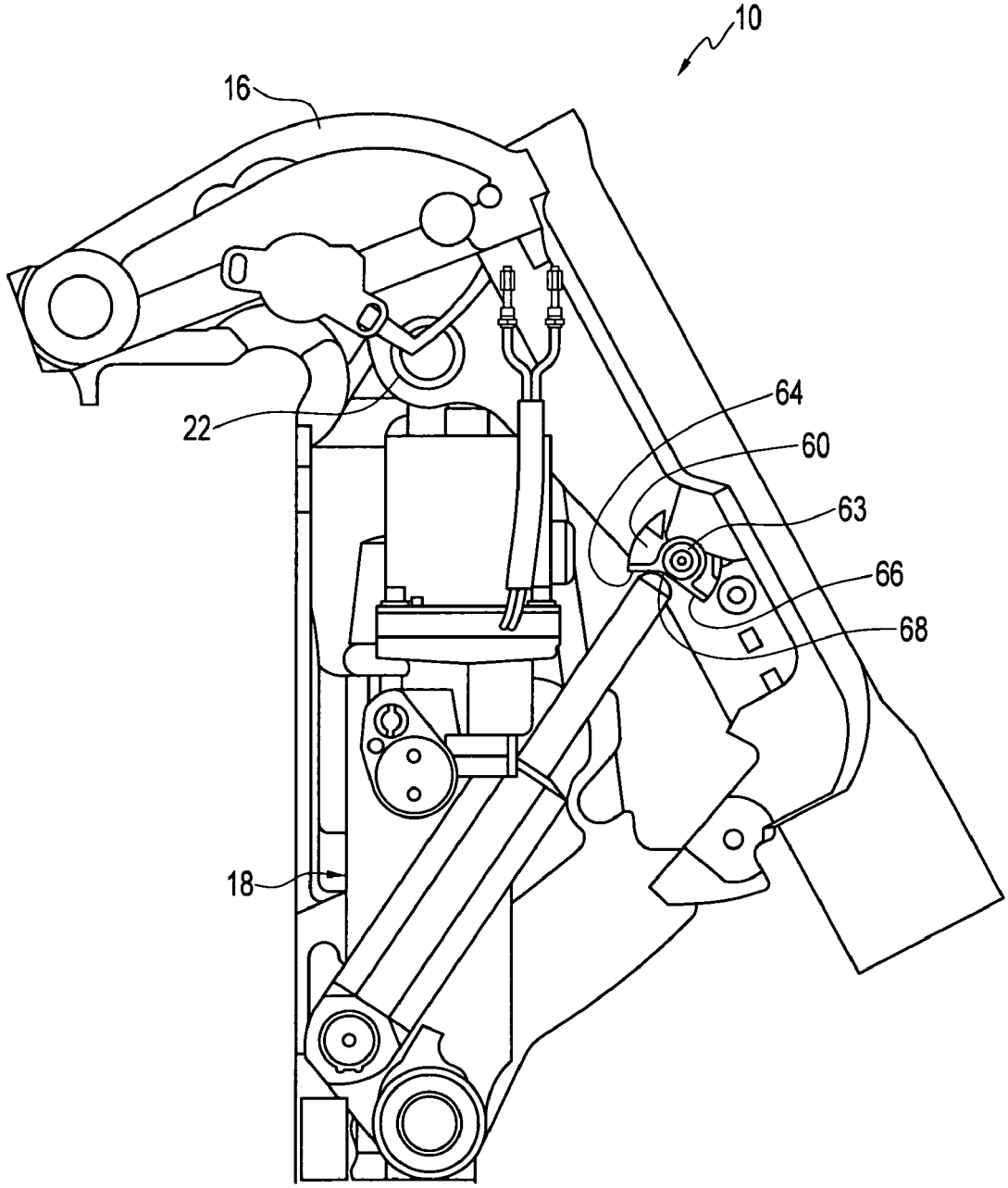
FIG. 14 is a side sectional view of the trim and tilt system of FIG. 1 shown in a mid-position.
Figure 15:
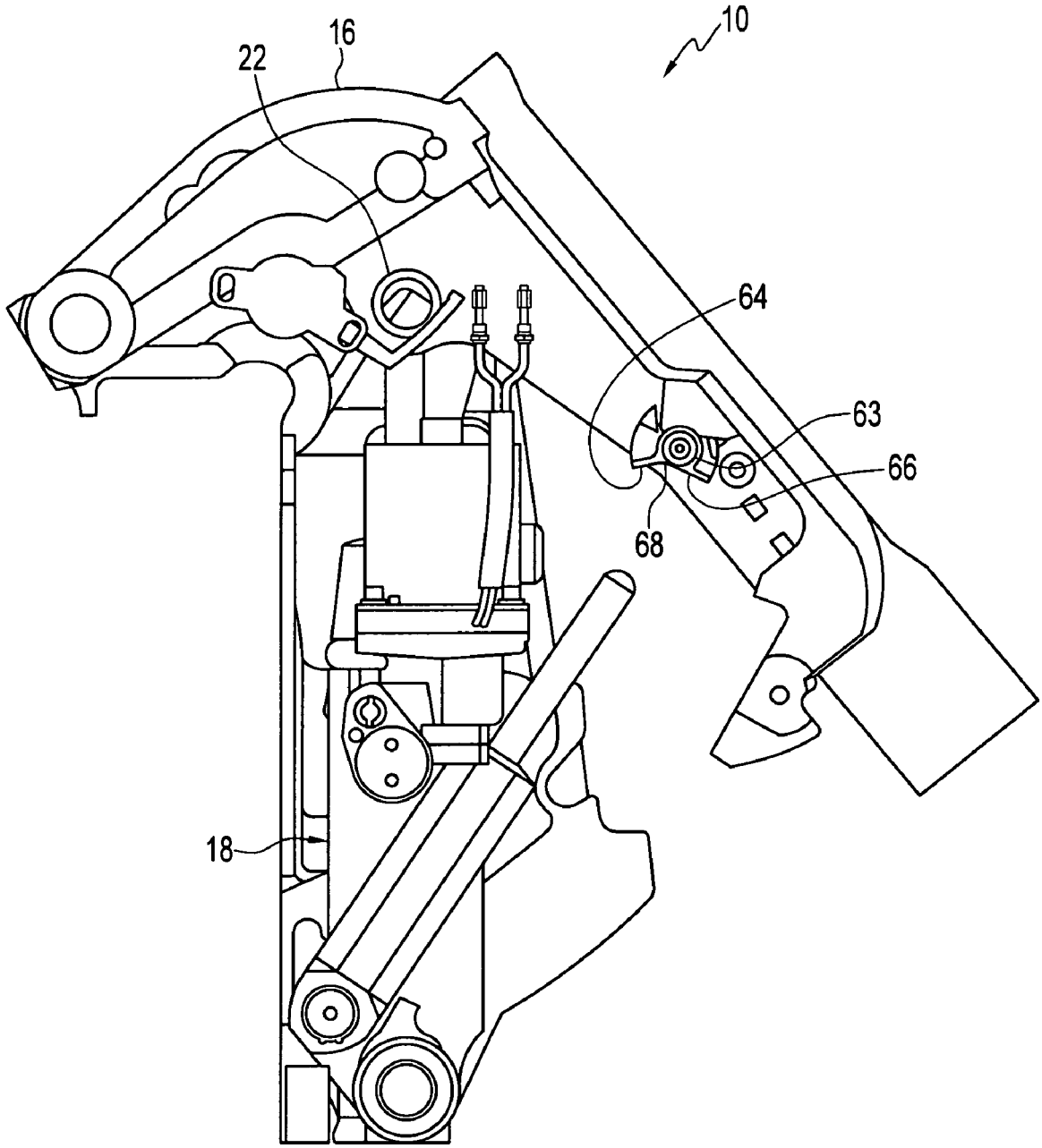
FIG. 15 is a side sectional view of the trim and tilt system of FIG. 1 in show in an upper position.

The stern bracket 14 is mounted on the transom 11 of the marine craft 12. The swivel bracket 16 supports the outboard propulsion unit 13, and is pivotally connected with the marine craft 12 at pivotal connection 20 which is located at an upper end of the stem bracket 14. The trim and tilt cylinder apparatus 18 has a lower end supported by the stern bracket 14 and is pivotally connected at an upper end with the swivel bracket 14 at pivotal connection 22, which is best shown in FIGS. 14 and 15.

Referring now to FIGS. 2 to 5, in which the trim and tilt cylinder apparatus 18 is shown in greater detail, the trim and tilt cylinder apparatus 18 comprises a tilt cylinder unit 24 and at least one trim cylinder unit 26, of which there are two in this example. The trim cylinder units 26 are on opposite sides of the tilt cylinder unit 24. The tilt cylinder unit 24 has a tilt cylinder 28, a tilt rod 30 and a piston (not shown) inside the tilt cylinder 28 which is connected to the tilt rod 30. The tilt rod 30 extends from a top 32 of the tilt cylinder 28. There is a clevis 34, in the form of an annular ring in this example, at an end of the tilt rod 30 that extends from the top 32 of the tilt cylinder 28. The clevis 34 is pivotally connected with the propulsion unit 13, e.g. a motor, of the marine craft 12.

Figure 2:
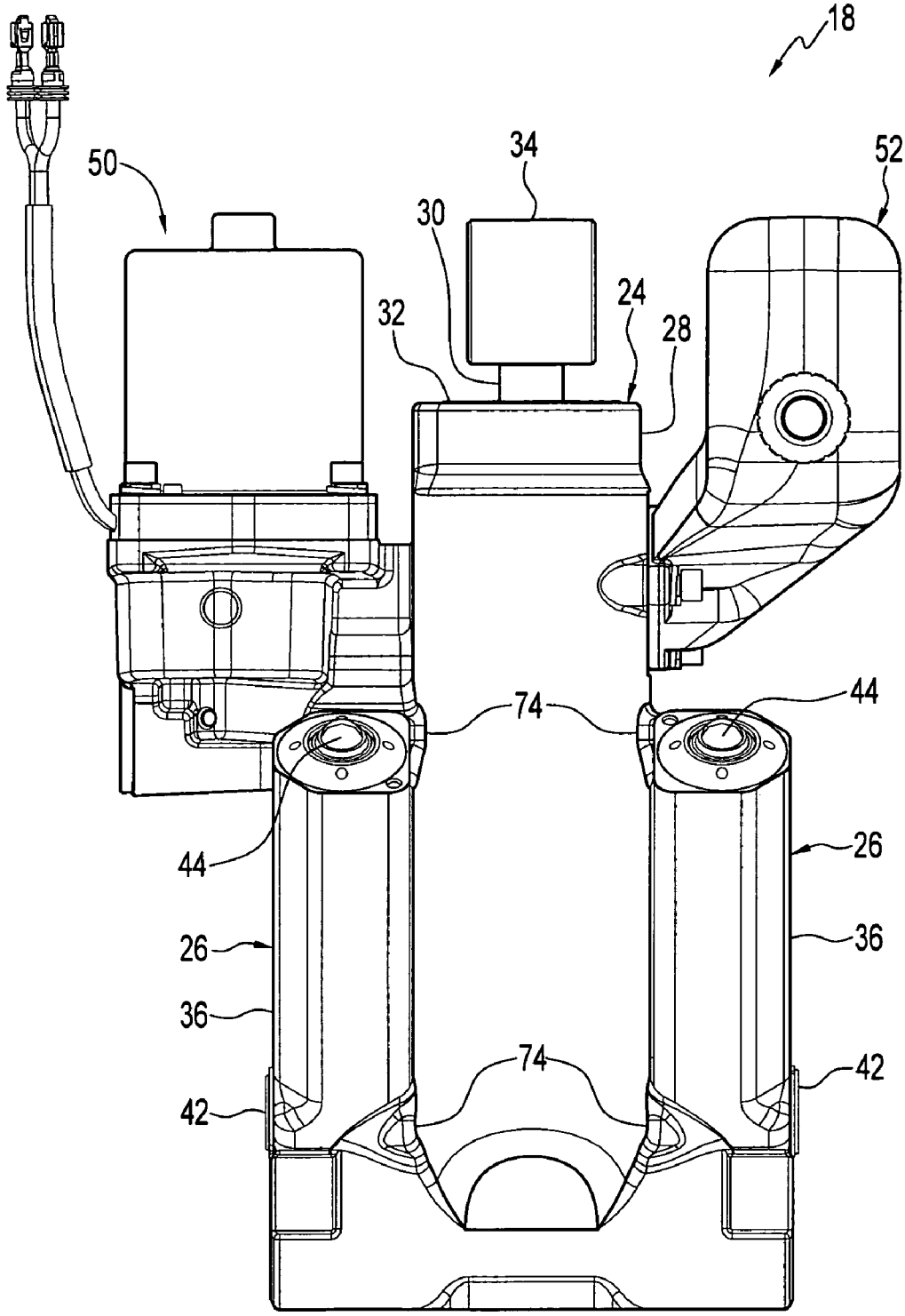
FIG. 2 is a front elevational view of a trim and tilt cylinder apparatus of the trim and tilt system of FIG. 1.
Figure 6:
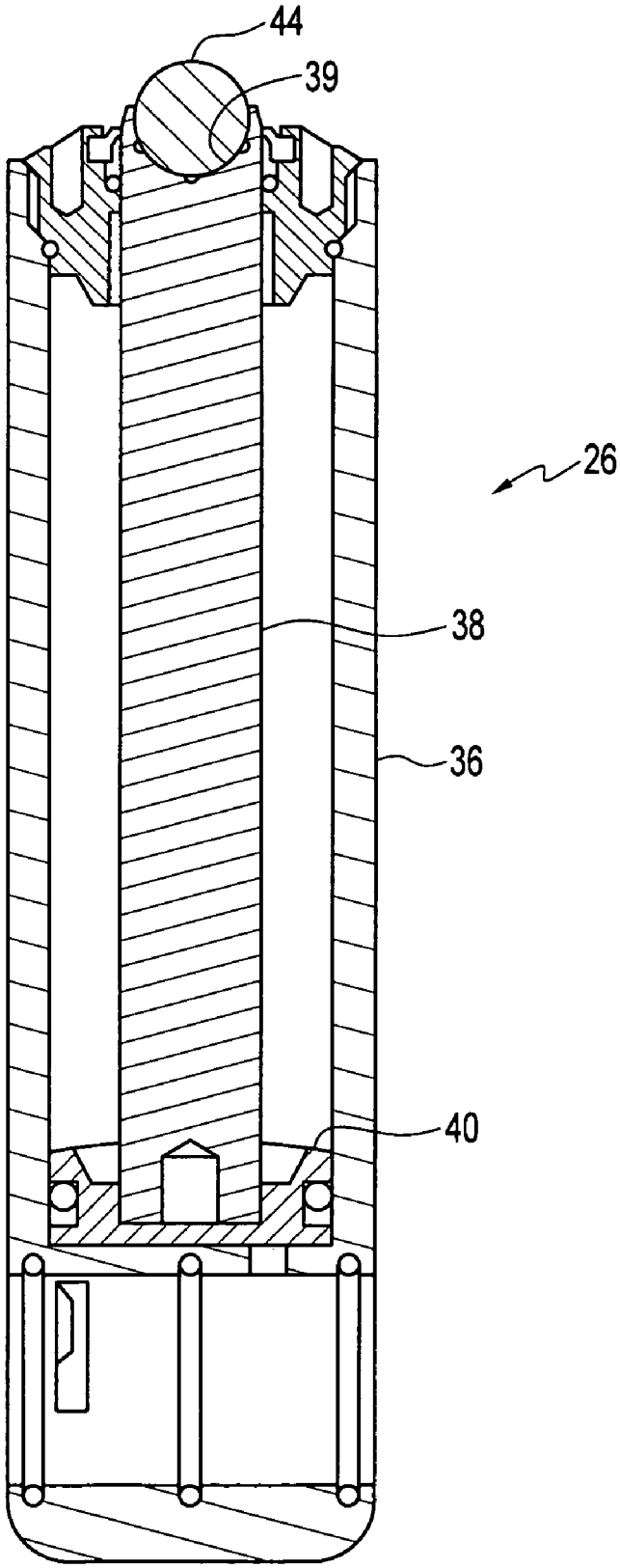
FIG. 6 is a side sectional view of a trim cylinder unit of the trim and tilt cylinder apparatus of FIG. 2.

Each of the trim cylinder units 26 has a trim cylinder 36, a trim rod 38 and a piston 40, which are best shown in FIG. 6 for this example. As shown in FIG. 2, each of the trim cylinder units 26 has a pivotal connection 42 with the tilt cylinder unit 24. In this example, each of the pivotal connections 42 of the trim cylinder units 26 are pivotally independent of each other, allowing the trim cylinder units 26 to move independently of each other, however this is not a requirement of the present invention. Each of the trims rod 38 extend out of respective ones of the trim cylinders 36 at an end opposite to the pivotal connections 42. Referring back to FIG. 6, in this example each of the trim rods 38 has a bore 39 at an end that extends from respective ones of the trim cylinders. The bore 39 of each of the trim rods 38 has a ball bearing 44 pressed therein. The piston 40 is connected with the trim rod 38 and moves along a longitudinal axis of the trim cylinder 36.

Figure 7:
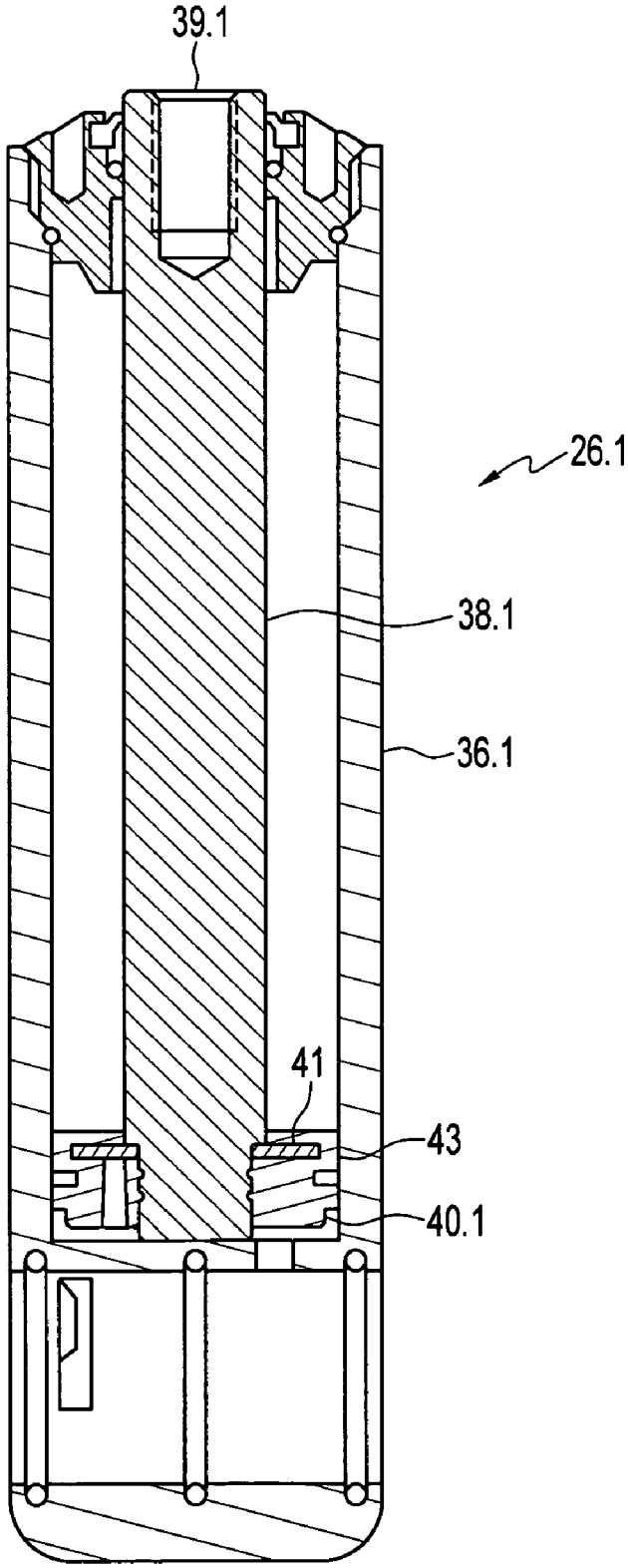
FIG. 7 is a side sectional view of another embodiment of a trim rod of a trim cylinder unit.

FIG. 7 shows a trim cylinder unit 26.1 according to another embodiment wherein like parts have been given like reference numerals with the additional numerical designation ".1". In the embodiment of FIG. 7 the piston 40.1 is in the form of a washer 41 and over-molding 43. The over-molding 43 being a resilient member. This embodiment of the trim cylinder unit 26.1 further allows for a pivotable trim receiver to be threadedly received at an aperture 39.1 of the trim rod 38.1 allowing for engagement of the of the trim cylinder unit and projections on the swivel bracket in alternate embodiments of the invention.

Figure 8:
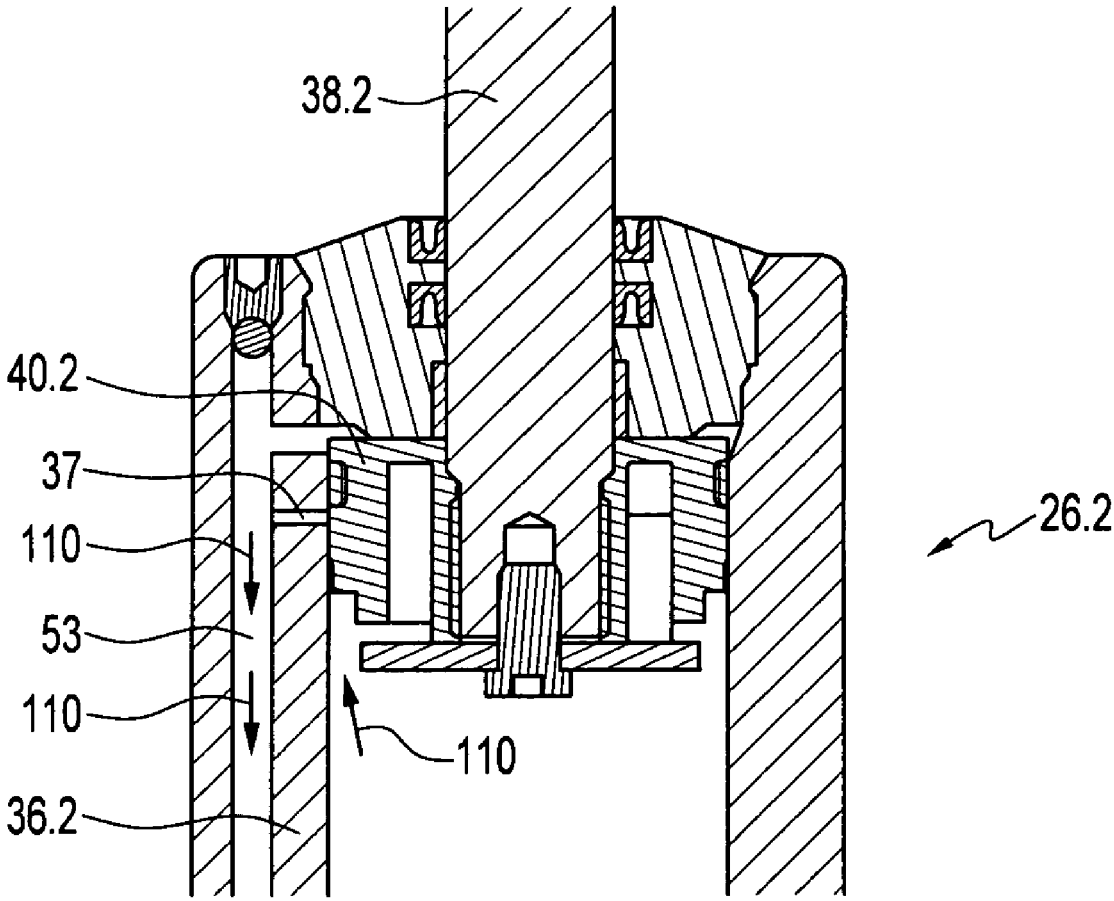
FIG. 8 is an side sectional view of an upper end of yet another embodiment of a trim cylinder.

FIG. 8 shows a trim cylinder unit 26.2 according to yet another embodiment wherein like parts have been given like reference numerals with the additional numerical designation ".2". In the embodiment of FIG. 8 the trim cylinder 36.2 is provided with a bore 37 at an upper end thereof which hydraulically connects the interior of the trim cylinder 36.2 to a down gallery 53 leading to a pumping unit. This permits up relief by allowing fluid to re-circulate, as shown generally by arrows 110, when the trim rod 38.2 is fully extended outside the trim cylinder 36.2. This inhibits the generation of high pressures and excessive motor current draw. It will be understood by a person skilled in the art that a similar bore may be provided on the tilt cylinder as a means of providing up relief.

Referring again to FIGS. 2 to 5, in this example, the trim and tilt cylinder apparatus 18 also includes a pumping unit 50 and a reservoir 52 for providing hydraulic fluid to the tilt cylinder unit 24 and each of the trim cylinder units 26. The pumping unit 50, the reservoir 52, the tilt cylinder unit 24, and the trim cylinder units 26 form a hydraulic circuit. Hydraulic fluid is pumped into and out of the cylinders 28 and 36 during operation of the trim and tilt apparatus 18 in order to move the marine propulsion unit 13 between the lower position and the upper position during the trim and tilt procedure.

Figure 9:
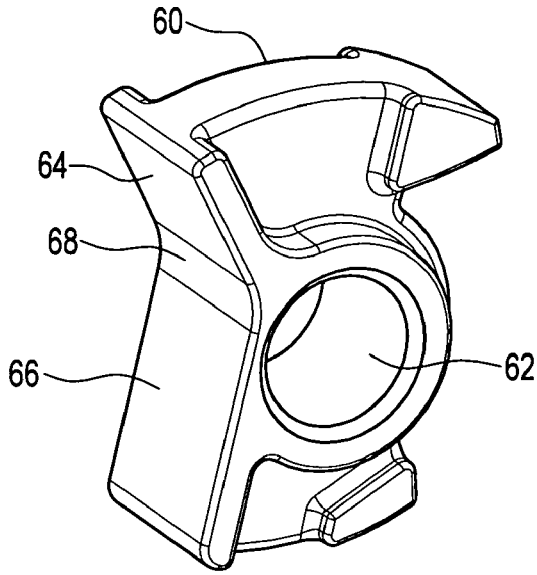
FIG. 9 is a perspective view of a trim receiver of the trim and tilt cylinder system of FIG. 1.
Figure 10:
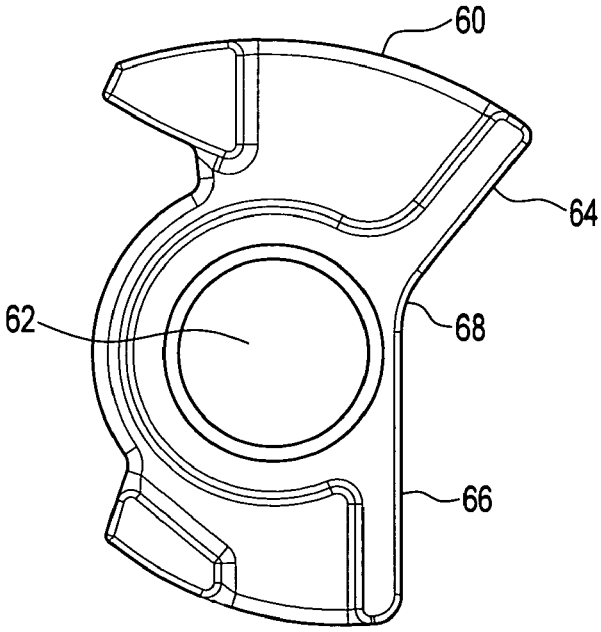
FIG. 10 is a side elevational view of the trim receiver of FIG. 9.
Figure 13:
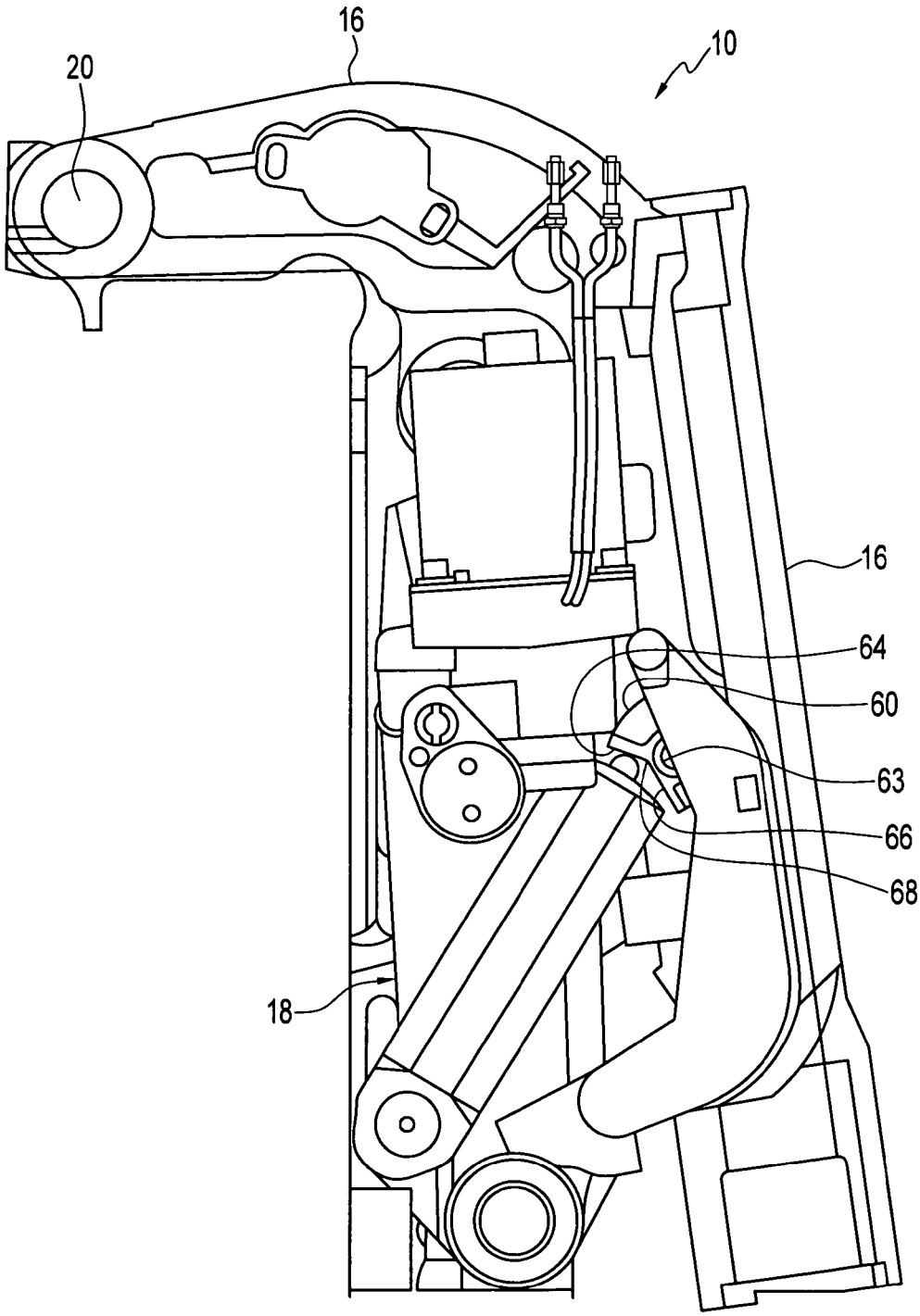
FIG. 13 is a side sectional view of the trim and tilt system of FIG. 1 shown in a lower position.

The trim and tilt apparatus 18 further includes a pair of trim receivers 60, each configured with respective ones of the trim cylinder units 26. The trim receivers 60 have a concave surface in this example and are best shown in FIGS. 9 and 10. Each of the trim receivers 60 has a bore 62 and is connected with the swivel bracket 14 at respective pivotal connections 63 as shown in FIGS. 13, 14 and 15. The pivotal connections 63 allow pivotation of respective ones of the trim receivers 60 allowing engagement with respective ones of the trim rods 38, as will be explained in more detail below.

Figure 11:
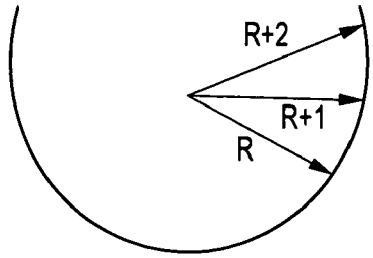
FIG. 11 is graphical representation of a spherical cone where the radius r varies according to the equation $r=R+x$, where R is the minimum radius and x is a positive integer.
Figure 12:
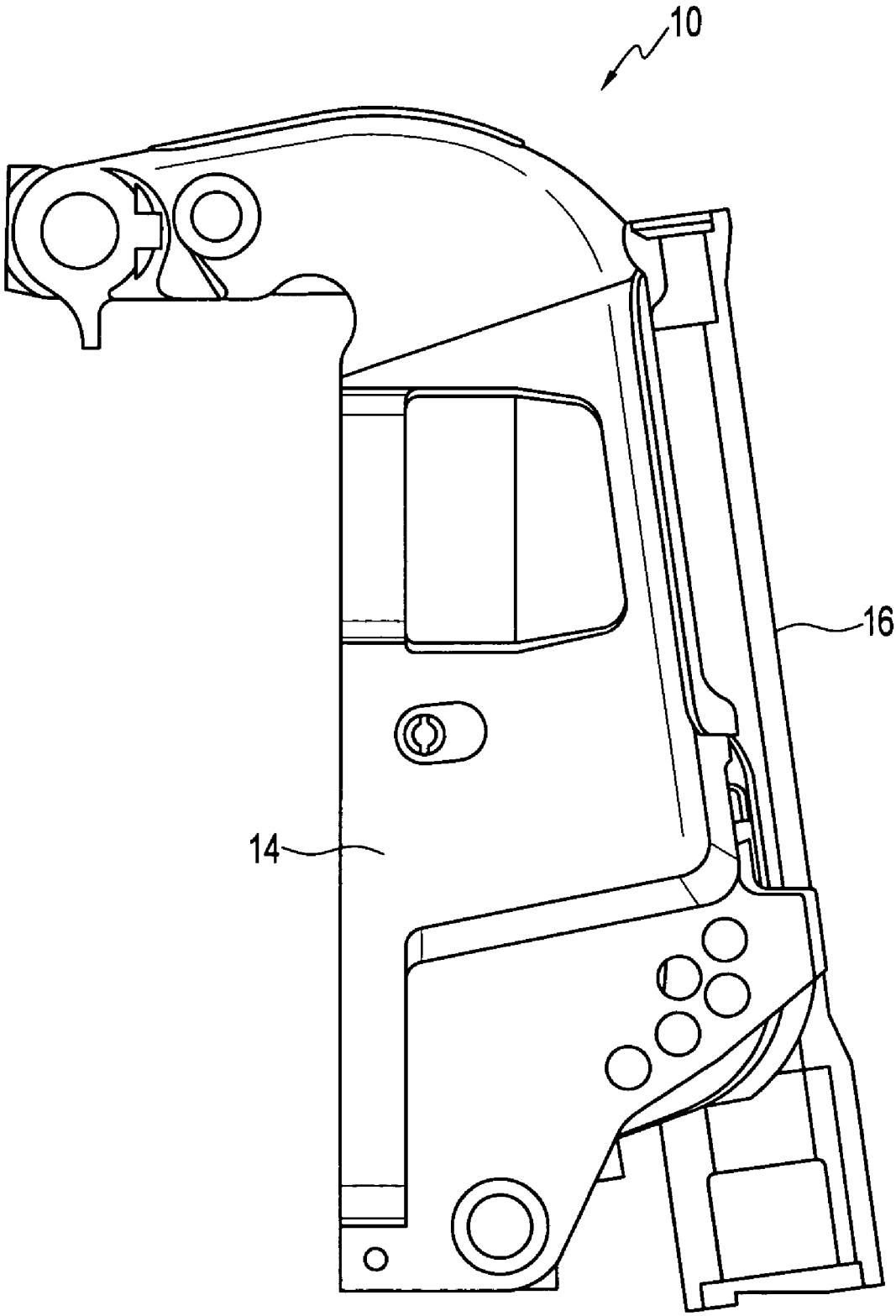
FIG. 12 is a side elevational view of the trim and tilt system of FIG. 1.

In this example, each trim receiver 60 has a first surface 64, a second surface 66 and a receptacle 68 therebetween. The first and second surfaces 64 and 66 are arranged at an inclination with respect to each other with the receptacle 68 forming a vertex of the concave surface. Each of the trim receivers 60 is in operative correspondence with respective ones of the trim rods 38 of the trim cylinder units 26. In an another embodiment, the trim receivers may form the shape of a spherical cone as illustrated in FIG. 11, where the radius r varies according to the equation r=R+x, where R is a minimum radius and x=1, 2, 3, 4, etc. Alternately, in yet another embodiment the trim receiver may be in the form of a three-dimensional concave or parabolic receptacle for receiving respective ones of the trim rods.

Figure 3:
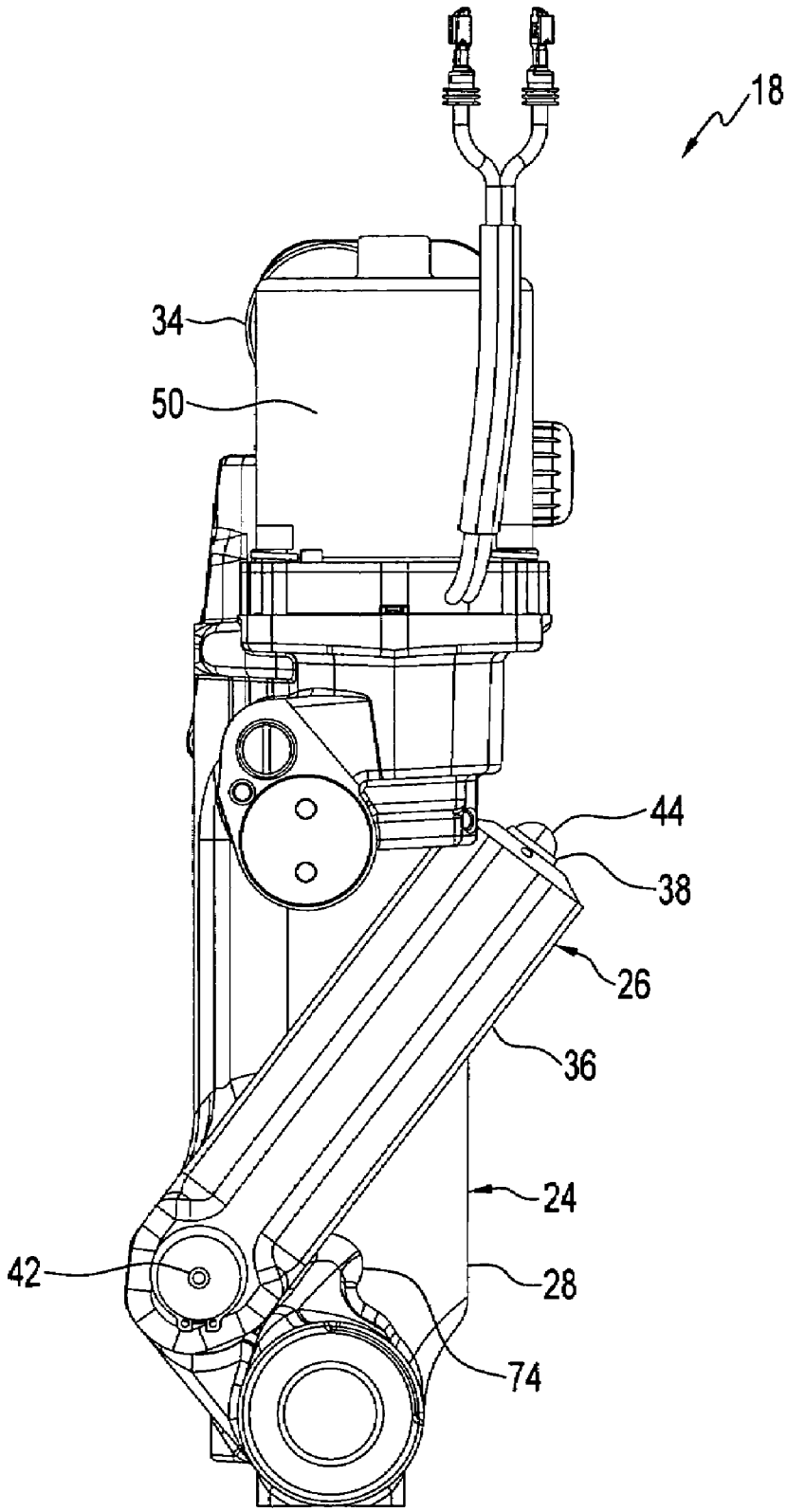
FIG. 3 is a side elevational view of a first side of the trim and tilt cylinder apparatus of FIG. 2.
Figure 4:
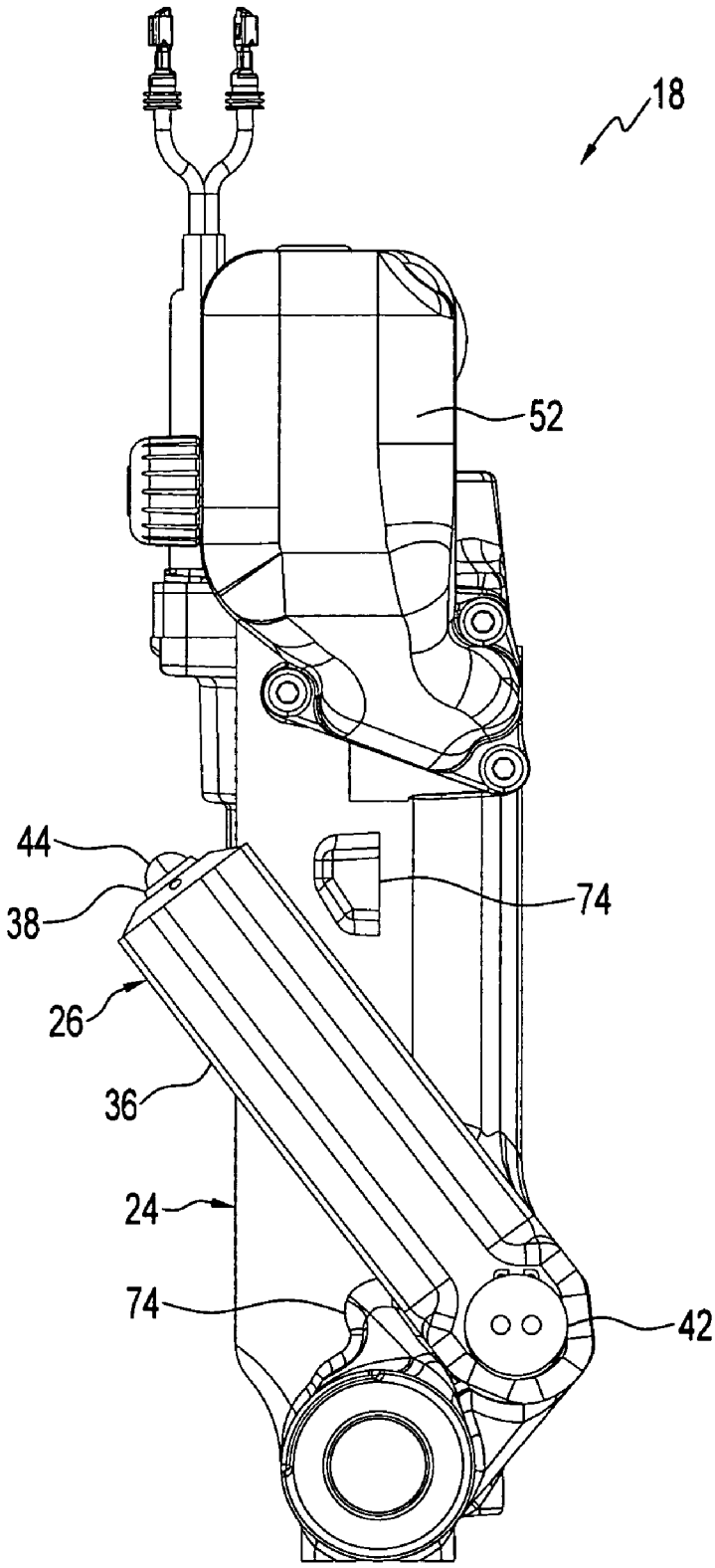
FIG. 4 is a side elevational view of a second side of the trim and tilt cylinder apparatus of FIG. 2.
Figure 5:
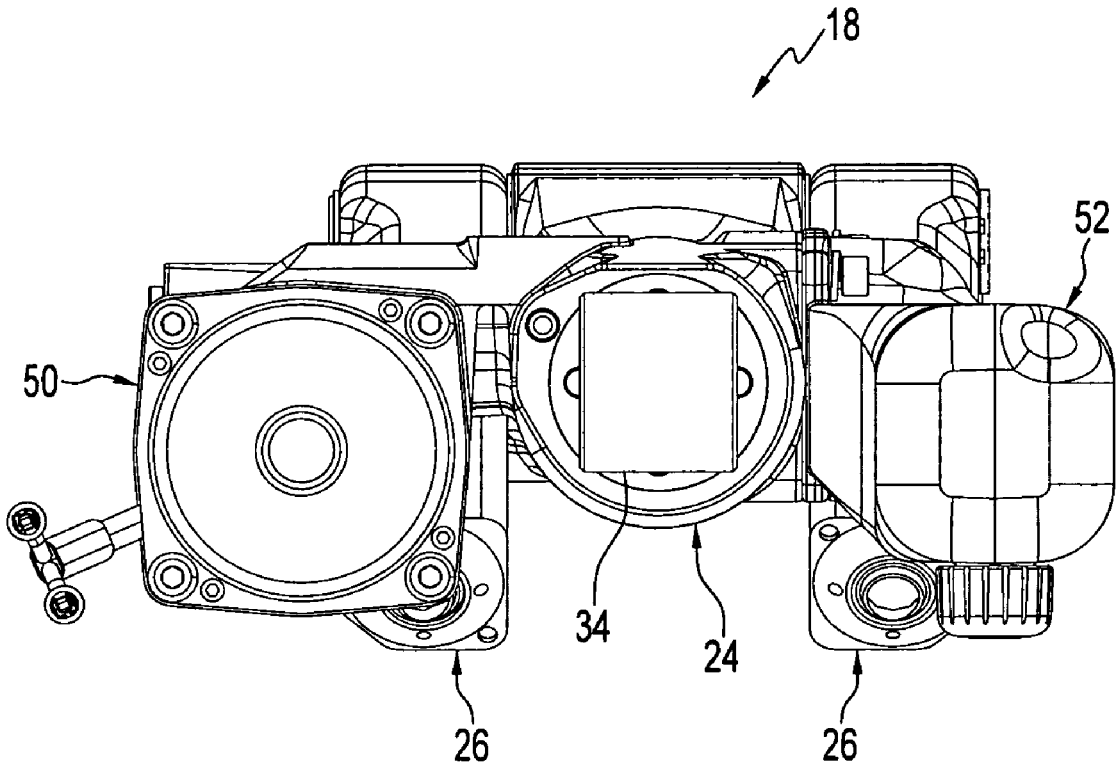
FIG. 5 is a top planar view of the trim and tilt cylinder apparatus of FIG. 2.

In this example the trim and tilt cylinder apparatus 18 further includes a pair of pads 74 for each of the trim cylinder units 26 which are best shown in FIGS. 2, 3, and 4. The pads are aluminum pads in this example, but can be resilient pads in other embodiments, e.g. non-linear springs, non-linear rubber bumpers or polyurethane pads. The pads 74 may also be inserts which can be installed and removed. The pads 74 act to limit the pivotation of each of the trim cylinder units 26 about respective ones of the pivotal connections 42. The trim rods 38 are held in operative engagement with the trim receivers 60 by limiting the pivotation of the pivotal connections 42, as will be explained in more detail below.

In operation, when the propulsion unit 13 of the marine craft 12 is to be moved from the lower position to the upper position, the pumping unit 50 actuates the tilt cylinder unit 24 and the trim cylinder units 26 from the position shown in FIG. 13. The tilt rod 30 extends from the tilt cylinder 28 causing the swivel bracket 16 to pivot upwardly about connection 22. The trim rods 38 extend from respective ones of the trim cylinders 36 causing the ball bearings 44 on the trim rods 38 to come into operative engagement with respective ones of the trim receivers 60 on the swivel bracket thereby pivoting the swivel bracket 16 upwardly at connection 20. This phase of the operation is considered the trimming phase.

The trimming phase ends when the trim rods 38 are fully extended out of the trim cylinders 36, as shown in FIG. 14. After the trim rods 38 have extended fully out of the trim cylinders 36, the tilt rod 30 continues to pivot the swivel bracket 16, and the trim receivers 60 move away from the ball bearings 44 of the trim rods 38, as shown in FIG. 15. This phase of the operation is considered the tilting phase of the operation. The swivel bracket 16 continues to pivot at connection 20 until the tilt rod 30 is fully extended out of the tilt cylinder 28.

Considering now the opposite motion, when the trim and tilt apparatus 10 moves the marine propulsion unit 13 between the upper position and the lower position. The pumping unit 50 actuates the tilt cylinder unit 24 to retract the tilt rod 30 into the tilt cylinder 28, thereby causing the swivel bracket 16 to pivot downwardly about the connection 22. Eventually the trim receivers 60 on the swivel bracket 16 come into contact with respective ones of the ball bearings 44 on each of the trim rods 38.

In this example, the ball bearings 44 come into contact with one of either the first surface 64 or the second surface 66 of respective ones of the trim receivers 60, which then guide the trim rods 38 towards the receptacles 68. Normally, the ball bearings 44 of the trim rods 38 initially contact the first surface 64 of respective ones of the trim receivers 60. The trim receivers 60 then pivot so that the force exerted by the trim receivers 60 on the trim rods 38 is along the longitudinal axis of the trim cylinder units 26.

The pumping unit 50 continues to actuate the tilt cylinder unit 24, and also the trim cylinder units 26 so that the trim rods 38 retract into respective ones of the trim cylinders 36, until both the tilt rod 30 and the trim rods 38 are fully retracted in the respective tilt cylinder 28 and trim cylinders 36, as shown in FIG. 13.

The trim receivers 60 of the present invention provide the advantage of allowing the trim rods 38 to self align within the trim receivers 60, such that as the propulsion unit 13 is moved between lower and upper positions the force exerted by the propulsion unit 13 through the trim receivers 60 on the trim rods 38 is substantially along the longitudinal axis of the trim cylinders 36 and the trim rods 38. This minimizes the stress put on the trim cylinder units 26 as the propulsion unit 13 is moved between the lower and the upper positions, and also allows the trim cylinder units 26 to handle a greater load.

Another advantage of the present invention is achieved by the pads 74, which limit the pivotal range of the pivotal connections 42. The predetermined range of the pivotal connections 42 ensures that the trim rods 38 will always come into operative engagement with respective ones of either the first surface 64 of the trim receiver 60, the second surface of the trim receiver 66 or directly with the receptacle 68 of the trim reciever.

As will be apparent to those skilled in the art, various modifications may be made within the scope of the appended claims.

What is claimed is:

1. A trim and tilt system for use with an outboard propulsion unit on a marine craft having a transom, the trim and tilt system comprising:

a stern bracket configured to be mounted on the transom of the marine craft;

a swivel bracket for supporting the outbound propulsion unit, the swivel bracket being pivotally supported on an upper end of the stern bracket;

a tilt cylinder unit having a lower end supported by the stern bracket and an upper end in pivotal engagement with the swivel bracket;

at least one trim cylinder unit having a longitudinal axis, a lower end in pivotal arrangement with the tilt cylinder unit, and a trim rod for engagement with the swivel bracket, the swivel bracket having means for aligning the trim rod therewith, whereby the force exerted by the swivel bracket on the trim cylinder unit is substantially along the longitudinal axis;

a pivotal connection between said tilt cylinder unit and said at least one trim cylinder unit; and means for actuating the tilt cylinder unit and the trim cylinder units.

2. The trim and tilt system as claimed in claim 1, further including means for limiting the pivotation of the trim cylinder unit, the means for aligning the trim rod cooperating with the means for limiting the pivotation of the trim cylinder unit.

3. The trim and tilt system as claimed in claim 2, wherein the means for limiting the pivotation of the trim cylinder unit comprises a pair of pads.

4. The trim and tilt system as claimed in claim 3, wherein the pads are resilient.

5. The trim and tilt system as claimed in claim 1, wherein the means for aligning the trim rods comprises a concave shaped surface.

6. The trim and tilt system as claimed in claim 5, wherein the concave shaped surface includes a receptacle at a vertex thereof.

7. The trim and tilt system as claimed in claim 1, wherein there are a pair of the trim cylinder units, the trim cylinder units being on opposite sides of the tilt cylinder unit.

8. The trim and tilt system as claimed in claim 1, wherein there are at least two trim cylinders units, each said trim cylinder moving independently of said other trim cylinder units.

9. The trim and tilt system as claimed in claim 1, wherein a piston of the trim cylinder unit is in the form of a washer and an over-molding, the over-molding being an resilient member.

10. A method of reducing stress on a trim cylinder unit of a trim and tilt system during trimming and tilting of a marine propulsion unit, the stress resulting from the weight of the marine propulsion unit being transmitted through a swivel bracket to the trim cylinder unit, the method comprising the step of transmitting the weight of the marine propulsion unit substantially along the longitudinal axis of the trim cylinder unit throughout the trimming of the marine propulsion unit wherein the step of transmitting the weight of the marine propulsion unit further includes the step of limiting the pivotation of the trim cylinder unit so that the trim rod remains in operative engagement with the swivel bracket.

11. The method of reducing stress as claimed in claim 10, wherein the step of transmitting the weight of the marine propulsion unit includes the step of pivoting an end of a trim rod of the trim cylinder unit in a concave shaped receptacle of the swivel bracket.

12. A trim and tilt system for use with an outboard propulsion unit on a marine craft having a transom, the trim and tilt system comprising:

a stern bracket configured to be mounted on the transom of the marine craft;

a swivel bracket for supporting the outbound propulsion unit, the swivel bracket being pivotally supported on an upper end of the stern bracket;

a tilt cylinder unit having a lower end supported by the stern bracket and an upper end in pivotal engagement with the swivel bracket;

at least one trim cylinder unit having a longitudinal axis and a lower end, and a trim rod for engagement with the swivel bracket, wherein the swivel bracket aligns the trim rod therewith, whereby the force exerted by the swivel bracket on the trim cylinder unit is substantially along the longitudinal axis;

a pivotal connection between said tilt cylinder unit and said at least one trim cylinder unit, wherein said pivotal connection engages said lower end of said trim cylinder unit; and an actuator that actuates the tilt cylinder unit and the trim cylinder units.

* * * * *